United States Patent [19]

Weber

[11] 4,344,831

[45] Aug. 17, 1982

[54] APPARATUS FOR THE GENERATION OF GASEOUS FUEL

[76] Inventor: Charles T. Weber, 11307 Green Bay Ave., Chicago, Ill. 60617

[21] Appl. No.: 186,607

[22] Filed: Sep. 12, 1980

[51] Int. Cl.[3] ..... C25B 9/00

[52] U.S. Cl. ..... 204/228; 204/274; 204/275; 204/277; 204/278; 123/3; 123/DIG. 12

[58] Field of Search ..... 123/3, 119 E, DIG. 12; 204/129, 274, 275, 277, 278, 228

[56] References Cited

U.S. PATENT DOCUMENTS

| | | | |
|---|---|---|---|
| 1,476,284 | 12/1923 | Clark | 204/129 |
| 1,581,944 | 4/1926 | Hausmeister | 204/129 |
| 1,819,917 | 8/1931 | Niederreither et al. | 204/129 |
| 1,965,813 | 7/1934 | Stuart | 204/129 |
| 2,365,330 | 12/1944 | Carmichael | 123/DIG. 12 |
| 2,496,623 | 2/1950 | Fragale | 123/DIG. 12 |
| 3,374,158 | 3/1968 | Lord et al. | 204/129 |
| 3,648,668 | 3/1972 | Pacheco | 123/DIG. 12 |
| 4,023,545 | 5/1977 | Mosher et al. | 123/3 |

*Primary Examiner*—R. L. Andrews
*Attorney, Agent, or Firm*—Ralph H. Dougherty

[57] ABSTRACT

A method and apparatus for the generation of a gaseous hydrogen or hydrogen and oxygen mixture for use as a fuel. The apparatus includes an electrolytic tank having means for circulating and cooling the electrolyte solution therein, gas removal means and a source of electric power communicating with the electrolyte solution. The method is characterized by dissociation of the aqueous portion of the electrolyte solution and maintaining the temperature of the electrolyte below 150° F.

5 Claims, 2 Drawing Figures

APPARATUS FOR THE GENERATION OF GASEOUS FUEL

BACKGROUND OF THE INVENTION

The present invention relates to the generation of gaseous fuel for internal combustion engines, particularly for such engines which use petroleum products to form explosive mixtures when vaporized in air.

It has long been known that internal combustion engines can be fueled by a mixture of hydrogen and oxygen as well as by the standard vaporized petroleum products. However, until recently, there has been no method for generating hydrogen in a practical manner which would avoid the problem of storage of hydrogen prior to use. When hydrogen is generated from water, it occupies many times the volume of the liquid water from which it is generated. Thus, storage facilities must be under high pressure at low temperature, which requires additional power input to compress and cool the hydrogen, or the hydrogen must be stored in large tanks which are unsuitable for connection to an internal combustion engine. In either case, the storage of hydrogen is extremely inefficient.

In the past several years, atmospheric pollution has increased many-fold from automotive emissions due to the fact that the burning of petroleum-based fuels results in the production of carbon monoxide and carbon dioxide which are emitted into the atmosphere. Internal combustion engines powered by hydrogen or a mixture of hydrogen and oxygen result in the emission of a small amount of hydrogen, a small amount of oxygen and principally water in the forms of liquid or vapor, none of which pollute the atmosphere.

It is preferable that both hydrogen and oxygen be provided in gaseous form to an internal combustion engine in ready-to-burn form. The present invention achieves this aim by employing an electrolytic cell having a plurality of carbon-plate electrodes divided into an equal number of anodes and cathodes, a source of water for injection into the cell, an electrolyte in solution in the water and a cell cooler located within the cell to maintain the temperature of the cell at a desired low level.

Although this invention is principally applicable to internal combustion engines, the gaseous fuel product is suitable for heating or any other fuel use.

OBJECTS OF THE INVENTION

The principal object of the present invention is to provide a method for generating a hydrogen-oxygen fuel suitable for powering internal combustion engines.

Another object of this invention is to provide apparatus for powering an internal combustion engine which will reduce polluting emissions into the atmosphere.

Another object of this invention is to provide a means for powering a vehicle utilizing water as one of the basic sources of energy.

BRIEF DESCRIPTION OF THE DRAWINGS

The foregoing and other objects of this invention will be better understood from the following detailed description and the appended drawings in which.

DETAILED DESCRIPTION

Figure 1:
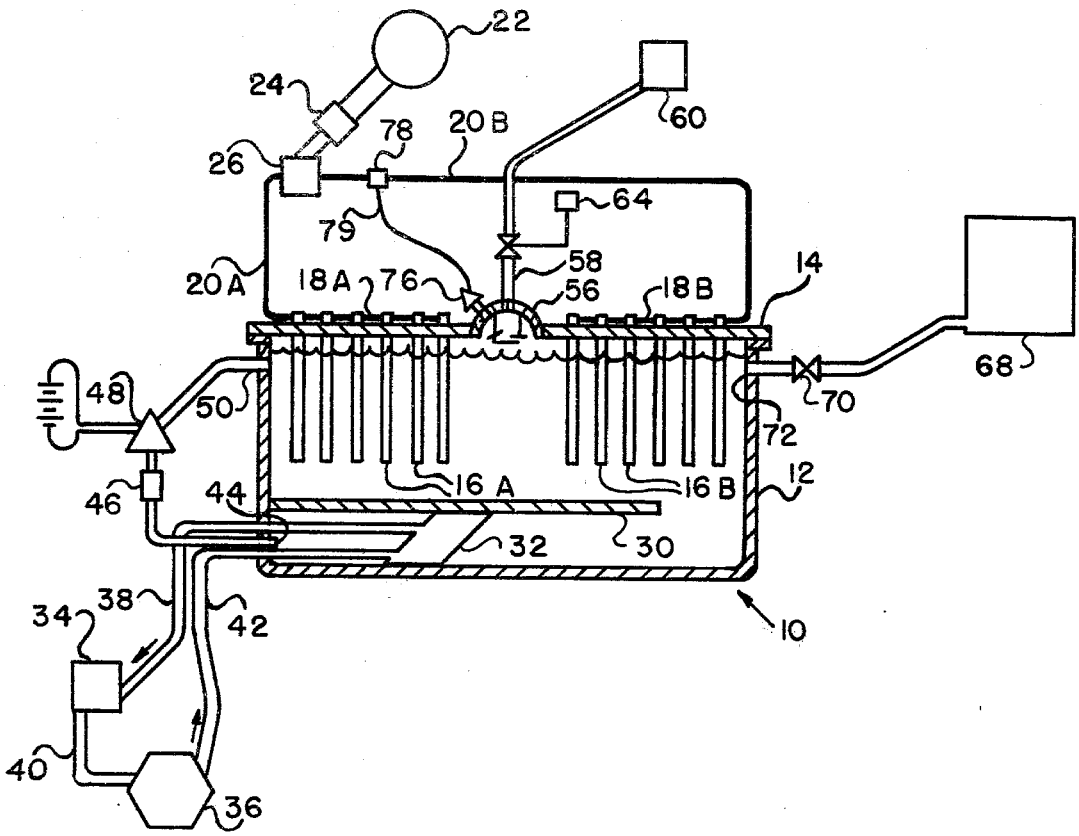
FIG. 1 is a schematic cross-section of my electrolytic cell apparatus showing the necessary connections.
Figure 2:
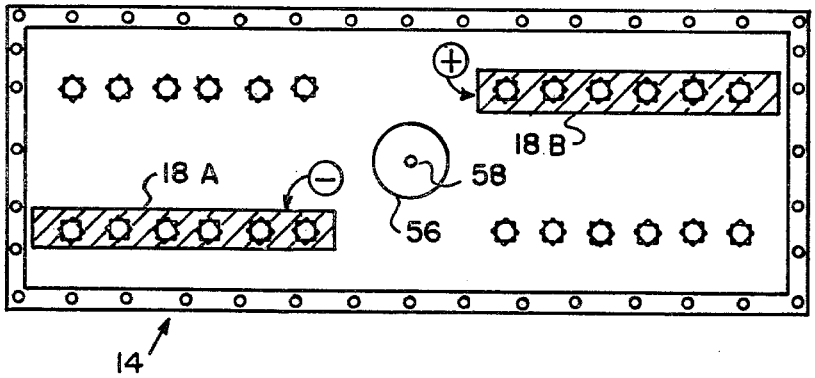
FIG. 2 is a top view of the cell of FIG. 1.

Referring now to FIG. 1, electrolysis unit 10 includes a tank 12 for containing electrolyte fluid, and having a cover 14 sealingly engaging tank 12. A plurality of electrode plates 16-A and 16-B depend from cover 14; the anodes 16-A are connected to bus bar 18-A exterior to tank 12, whereas the cathodes 16-B are connected to bus bar 18-B. The bus bars are connected through power leads 20-A and 20-B to an alternating current generator 22. The generator may be mounted on the engine and driven by it; preferably the generator current passes through a full bridge rectifier 24 and an alternating current filter 26 between the generator and the bus bars. This results in direct current being supplied to the bus bars.

The lower part of tank 12 is separated from the upper part by a separator or baffle 30 which extends across the tank and is open at one end. Within the lower chamber formed by the bottom of the tank and baffle 30 is an evaporative cooler 32 which is provided with a condenser 34 exterior to the tank and compressor 36 along with the necessary conduits 38, 40 and 42 for recirculating the cooling fluid within the system.

At the end of the lower chamber opposite the baffle opening is a fluid outlet 44. Fluid is cooled by passing it around evaporator-cooler 32, then removed from the lower chamber at outlet 44, passed through filter 46 and recirculating pump 48, then the electrolyte fluid is injected into the upper chamber through inlet 50.

A dome 56 in cover 14 is provided for the accumulation of gases. The dome is so constructed that fluid does not enter the product gas conduit. Outlet pipe 58 is connected to the apex of the dome to remove the product gases formed within the electrolytic cell. The fuel gas conduit communicates with a carburetor 60 or an intake manifold of an internal combustion engine. Valve 62 is provided in the conduit 58 to shut off the flow of gas to the carburetor upon command of solenoid 64; that is, when the ignition is not on, the solenoid 64 closes valve 62.

Make up water may be provided from water reservoir 68 through valve 70 and water inlet 72 to the interior of the tank 12.

A pressure regulator 76 is mounted in dome 56 to monitor the gas pressure within the dome. Pressure regulator 76 is connected to electrical switch 78 by connecting wire 79. Alternatively switch 78 can be a voltage regulator to vary the voltage within the electrical circuit or to open and close the circuit.

In operation, an electrolyte fluid is formed by the addition of a salt to the water within the electrolytic cell. Sodium chloride and calcium chloride are suitable salts. The fluid level is maintained to the top of the carbon plates 16. The electrodes are made of carbon rather than any other material, as I have found carbon to be resistant to disintegration during electrolysis.

An external source of power is required to start the generation of gaseous fuel in electrolytic cell 10. When this source of power is the internal combustion engine for which the cell generates fuel, the engine must be started by utilizing stored gaseous fuel or some outside source of power. As soon as hydrogen generation in cell 10 is sufficient to raise the pressure within dome 56 to a sufficient level to operate the engine, solenoid 64 is actuated to open valve 62 and the hydrogen-oxygen fuel gas flows to carburetor 60. Fluid is recirculated, filtered and cooled by removing it from the tank through outlet 44, pumping it by pump 48 through filter 46 and reinjecting it into the upper section of the electrolytic cell through water inlet 46 from which it passes through and around electrode plates 16, around the end of baffle 30, then through and around the bins of evaporator-cooler 32 and out of the cell. Filter 46 is optional, but is preferable to remove any particulate matter which may form within the cell, foam or impurities from the water. Distilled water or tap water can be employed. In addition, aqueous solutions of ammonia and some mild acids are also suitable electrolytes.

The salt concentration in the cell controls the amperage passing through the electrolyte, and the greater the current, the larger the amount of dissociated gases formed. Thus if a greater amount of current is desired for a given voltage, more salt is added to the cell. The amperage will also vary with the electrolyte level. As the level falls, the salt concentration increases, and with it the generation of gas increases.

I have found that it is necessary to maintain the electrolyte at a low temperature, below 150° F., and preferably below 100° F., to prevent vaporization of water, which will dilute the gaseous fuel product and be drawn off with it. It is possible to maintain the electrolyte temperature at or below 80° F. with a standard evaporator-cooler.

ALTERNATIVE EMBODIMENTS

As an alternative embodiment, I may employ baffles within the tank adjacent the water inlet 72 and/or water inlet 50 to prevent excessive turbulence of the electrolyte solution against the carbon plates. Also the electrode plates 16 may be horizontal, connected to bus bars through the side walls, instead of depending from the cover 14.

In another embodiment, baffles of a non-conducting material may be inserted between the electrodes to prevent contact between adjacent electrodes.

From the foregoing it is readily apparent that I have invented a new and improved method and apparatus for generating a gaseous fuel useful as a heat source as well as in an internal combustion engine which is non-polluting, the materials for which are readily available in all parts of the world.

What is claimed is:

1. Apparatus for the electrolytic generation of a hydrogen-oxygen fuel mixture comprising:

an electrolytic tank containing an electrolyte solution and having a plurality of carbon electrodes suspended therein;

a horizontally extending baffle in said tank beneath said electrodes partially dividing said tank into an upper chamber and a lower chamber, said baffle being open at one end;

a recirculating electrolyte line communicating with the upper chamber of said tank and with the closed end of said lower chamber and having solution recirculating means therein;

means connected to said tank for cooling the electrolyte solution;

a dome in the top of said tank for accumulating gases formed in said tank by electrolysis;

a gas outlet in the top of said dome; and a source of electric power communicating with said electrodes.

2. Apparatus according to claim 1 further comprising means in said dome for measuring the pressure within said dome, said pressure measuring means being connected to a voltage regulator for regulating the voltage in said circuit.

3. Apparatus according to claim 1 wherein an evaporator-cooler is positioned in said lower chamber to cool the electrolyte therein.

4. Apparatus according to claim 1 wherein said gas outlet is connected to the carburetor of an internal combustion engine.

5. Apparatus according to claim 1 further comprising a make-up water reservoir communicating with the interior of said tank.

* * * * *